US007052089B2

(12) United States Patent
May

(10) Patent No.: US 7,052,089 B2
(45) Date of Patent: May 30, 2006

(54) MULTI-POSITION HEADREST AND MECHANISM THEREFOR

(75) Inventor: Teddy J. May, Tupelo, MS (US)

(73) Assignee: Lane Furniture Industries, Inc., Tupelo, MS (US)

( * ) Notice: Subject to any disclaimer, the term of this patent is extended or adjusted under 35 U.S.C. 154(b) by 55 days.

(21) Appl. No.: 10/683,270

(22) Filed: Oct. 14, 2003

(65) Prior Publication Data

US 2005/0077771 A1 Apr. 14, 2005

(51) Int. Cl.
*A47C 1/02* (2006.01)
*A47C 1/10* (2006.01)

(52) U.S. Cl. ..... 297/408; 397/61

(58) Field of Classification Search ..... 297/408, 297/61; 248/118, 222.51; 16/357, 348
See application file for complete search history.

(56) References Cited

U.S. PATENT DOCUMENTS 2,781,082 A * 2/1957 Decker ..... 297/396
4,351,563 A * 9/1982 Hattori ..... 297/408
4,576,411 A * 3/1986 Kitamura ..... 297/353
4,576,413 A * 3/1986 Hatta ..... 297/408
4,989,914 A 2/1991 Pine
5,013,084 A 5/1991 May
5,058,953 A * 10/1991 Takagi et al. ..... 297/284.4
5,464,269 A * 11/1995 Mizelle ..... 297/61
5,511,853 A * 4/1996 Wallis ..... 297/364
5,642,918 A * 7/1997 Sakamoto et al. ..... 297/408
5,934,750 A * 8/1999 Fohl ..... 297/216.12
6,074,011 A * 6/2000 Ptak et al. ..... 297/408
6,142,558 A 11/2000 May
6,244,552 B1 * 6/2001 Adams et al. ..... 248/274.1
6,309,015 B1 10/2001 Pine
6,802,562 B1 * 10/2004 Hake et al. ..... 297/216.12

OTHER PUBLICATIONS 7 pages of photographs depicting a sofa bed positioning ratchet mechanism, no date, but believed to be prior art as of the filing date of this applications.

* cited by examiner

*Primary Examiner*—Peter M. Cuomo
*Assistant Examiner*—Sarah C. Burnham
(74) *Attorney, Agent, or Firm*—Sutherland Asbill & Brennan LLP

(57) ABSTRACT

A multi-position headrest for a chair and a mechanism for the headrest. The headrest can move between a forwardly tilted position and a non-tilted position. The headrest is supported by a multi-position bracket assembly. The bracket assembly includes two bracket members, one of which has an arcuate slot and the other of which has a mounting member adapted to move along the arcuate slot. A catch member is mounted for rotation on the mounting member. The catch member has angled edges at each end. As the mounting member moves along the slot, the catch member is rotated by contact with a shoulder and an alignment stop between orientations in which it engages the shoulder, establishing the forwardly tilted position, and orientations in which it does not engage the shoulder, allowing relative pivotal movement of the bracket assembly to return to the non-tilted position.

13 Claims, 10 Drawing Sheets

MULTI-POSITION HEADREST AND MECHANISM THEREFOR

BACKGROUND OF THE INVENTION

1. Field of the Invention

The invention relates to headrests capable of assuming multiple angular positions that may be used with chairs and other user supports, and to mechanisms for supporting and actuating such headrests.

2. Description of Related Art

A headrest is a portion of a seat or chair or other arrangements for seating or reclining that provides direct support for a user's head and neck. Headrests are also sometimes found on beds and sofa beds. In general, headrests reduce or eliminate neck fatigue, and can help to position a user's head in a more comfortable or appropriate position for a particular task. Headrests may be fixed or adjustable relative to the other portions of the seating support, depending on the type of support.

As one example, upholstered rocking and reclining chairs usually have an integrated backrest and headrest. Typically, the backrest and headrest are both suitably padded to provide the user with comfortable support for the back, neck, and head. In many chairs of this type, the headrest is positioned at the same angle as the backrest and is not moveable with respect to the backrest.

Although many upholstered rocking and reclining chairs include a fixed headrest integral with the backrest, it is sometimes desirable to include a headrest that is moveable with respect to the backrest. A headrest that is moveable with respect to the backrest may be tilted or otherwise positioned for maximum user comfort. For example, if the user is sitting in a chair in a reclined or semi-reclined position, a forwardly tilted headrest would allow the user's head to be supported in a more upright position relative to his or her body, which may assist with reading, watching television, and other leisure activities.

Various mechanisms are known for connecting separate headrests and backrests and for allowing one to be moved with respect to the other. The known mechanisms differ in the amount of adjustability allowed, the load carrying capacity of the mechanism, and the complexity of the mechanism. A number of the known mechanisms are relatively complex and, therefore, may be costly and difficult to implement.

SUMMARY OF THE INVENTION

One aspect of the invention relates to a multi-position support bracket. The support bracket comprises a first bracket member, a second bracket member, a catch member, and an alignment stop. The first bracket member has an arcuate slot formed therein and a raised portion defining a shoulder substantially proximate to the arcuate slot. The second bracket member is pivotally connected to the first bracket member and includes a mounting member constructed and arranged to move along the arcuate slot in the first bracket member as the first and second bracket members are pivoted with respect to one another. A catch member is rotatably mounted on the mounting member atop the first bracket member. The catch member has first and second ends, each of the ends having a pair of angularly oriented edges. Each end is adapted to engage at least a portion of the shoulder when the catch member is oriented in a shoulder engaging position and to prevent engagement with the shoulder when the catch member is oriented in a non-engaging position. An alignment stop is mounted on the first bracket member substantially proximate to one end of the arcuate slot. The alignment stop is sized and arranged to be received in one of the ends of the catch member to orient the catch member alternately in the shoulder engaging and non-engaging positions.

Using the multi-position support bracket, a first pivotal movement of the first bracket member relative to the second bracket member in a first direction from an initial position causes engagement of the catch member and the alignment stop, thereby causing the catch member to assume the shoulder engaging position, such that a movement of the first bracket member relative to the second bracket member in a second direction will cause engagement of the catch member and the shoulder, thus preventing further movement in the second direction. Additionally, a second pivotal movement subsequent to the first pivotal movement of the first bracket member relative to the second bracket member in the first direction causes engagement of the catch member and the alignment stop, thereby causing the catch member to assume the shoulder non-engaging position so as to allow the first and second bracket members to be returned to the initial position when moved in the second direction.

Another aspect of the invention relates to a chair comprising a seat, a back including a headrest portion and a backrest portion, and one or more multi-position support brackets connected between the headrest portion and the backrest portion so as to mount the headrest portion on the backrest portion for movement between a forwardly tilted position and a non-tilted position and for retention in the tilted position. Each of the one or more support brackets includes the features described above.

These and other aspects, features, and advantages of the invention will be described below.

BRIEF DESCRIPTION OF THE DRAWINGS

The invention will be described with respect to the following drawing Figures, in which like reference numerals represent like features throughout the several views, and in which.

DETAILED DESCRIPTION

Figure 1:
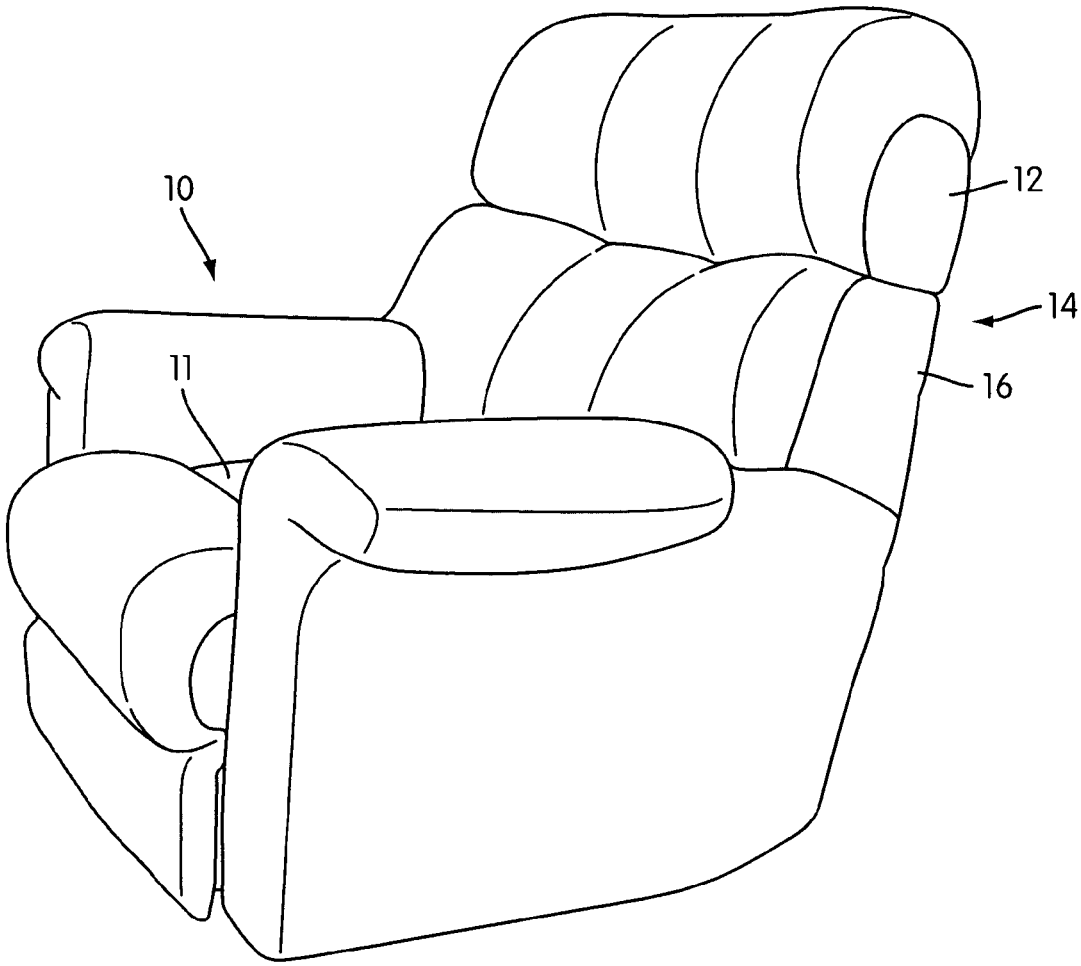
FIG. 1 is a perspective view of an upholstered chair including a multi-position headrest portion according to an embodiment of the invention.

FIG. 1 is a perspective view of a chair 10 that includes a multi-position headrest portion 12 embodying the principles of the present invention. The chair 10 is generally of the upholstered, reclining type, although multi-position headrest portions 12 may be used on substantially any type of chair or seat, as well as any other type of body support for which multi-position head support is desired.

The precise details of the chair seat 11 and the reclining mechanism of the chair 10 are not critical to the use or function of the multi-position headrest portion 12 and, thus, will not be described in detail here. Descriptions of reclining chairs and their mechanisms may be found, for example, in commonly-assigned U.S. Pat. Nos. 6,309,015, 6,142,558, 5,013,084, and 4,989,914, the contents of which are incorporated by reference in their entirety. However, the types of reclining mechanisms that may be included in the chair 10 are not limited to the mechanisms described in those patents.

Figure 2:
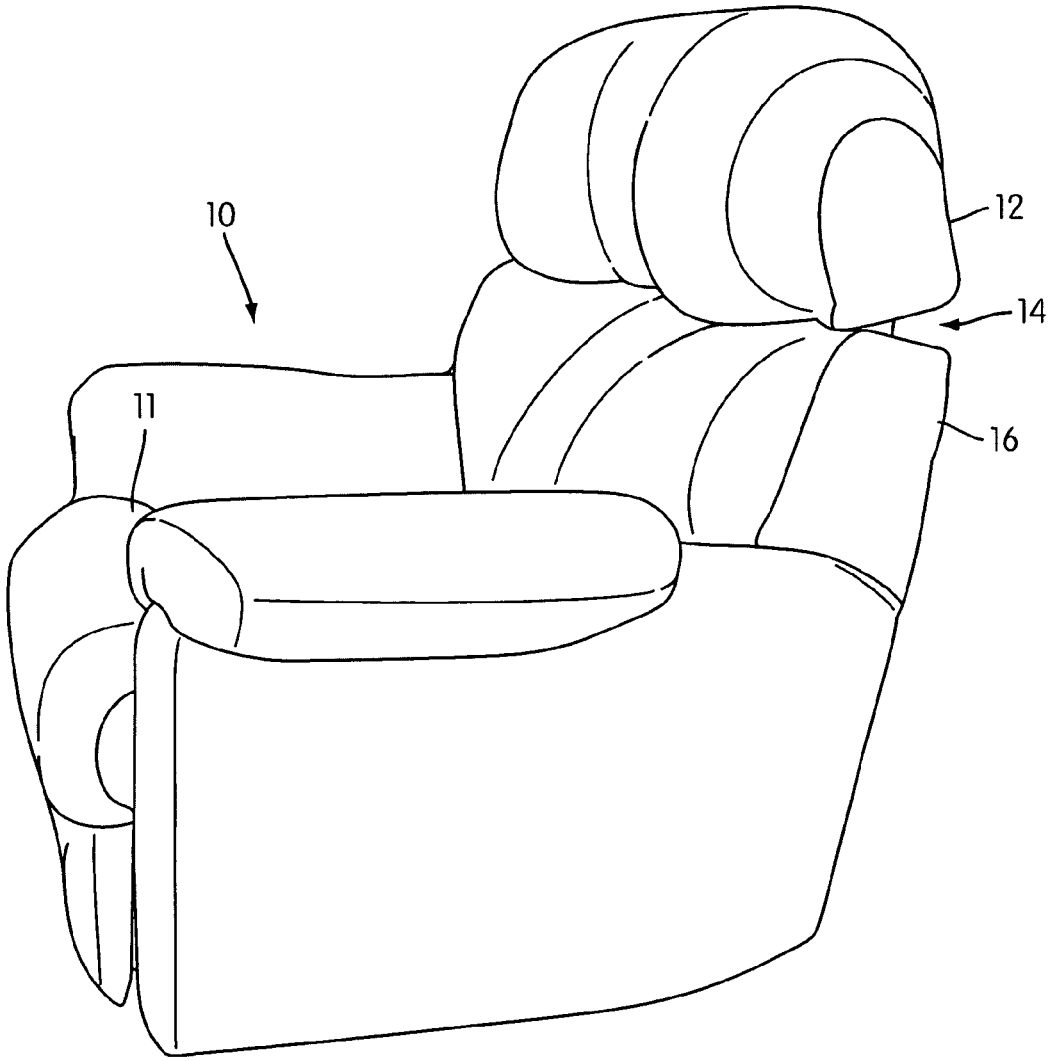
FIG. 2 is another perspective view of the upholstered chair of FIG. 1 showing the multi-position headrest portion in a forwardly tilted position.

The chair 10 has a back, generally indicated at 14, that includes a backrest portion 16 as well as the multi-position headrest portion 12. The multi-position headrest portion 12 is pivotally mounted on the backrest portion such that in may assume one of two positions: a first non-tilted position (shown in FIG. 1) and a second, forwardly tilted or angled position (shown in FIG. 2, another perspective view of the chair 10). Typically, the multi-position headrest portion 12 has a tilt in the range of about 5° to about 30° in the forwardly tilted position, although greater and lesser degrees of tilt are possible. In one embodiment using a padded, upholstered reclining chair, a tilt of 17° has been found to enhance user comfort.

The movement sequence for the headrest portion 12 is as follows. In order to move the multi-position headrest portion 12 from the non-tilted position to the forwardly tilted position, the user would manually tilt the multi-position headrest portion 12 forwardly to the end of its angular travel and would then allow the multi-position headrest portion 12 to fall back (or, alternatively, would push the headrest portion 12 back) toward the initial position of FIG. 1. However, as the multi-position headrest portion 12 is moved along the path back toward the initial position of FIG. 1, it will stop and become locked in the tilted position of FIG. 2.

In order to return the multi-position headrest portion 12 to the non-tilted position of FIG. 1, the user would once again move the multi-position headrest portion 12 forwardly to the end of its angular travel, and would then allow the multi-position headrest portion 12 to again fall back toward the non-tilted position of FIG. 1. As the multi-position headrest portion is moved back toward the non-tilted or initial position on the second pass in the sequence described, it will not stop at the tilted position but will instead fall back to the non-tilted or initial position of FIG. 1. The mechanism that allows the motion of the multi-position headrest portion 12 will be described below.

Figure 3:
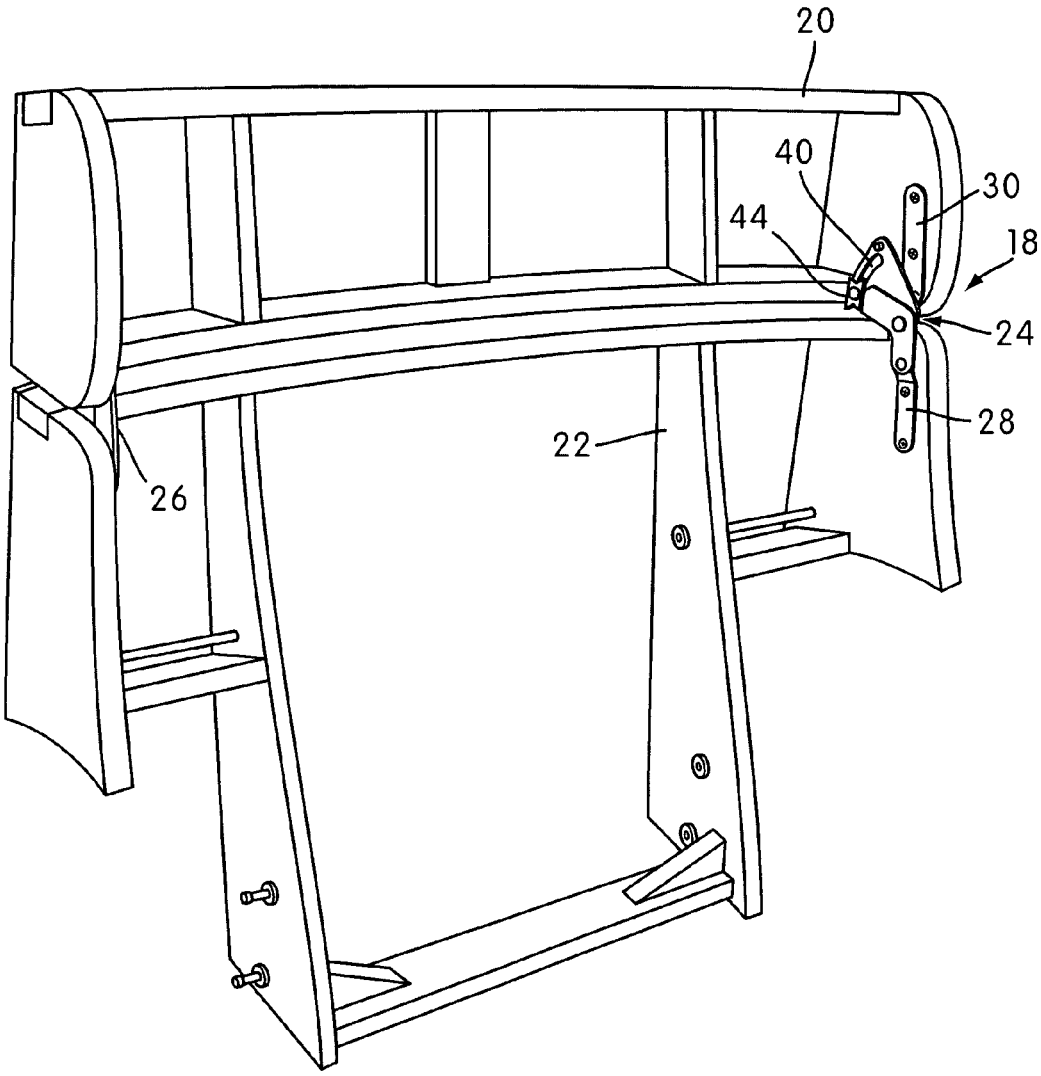
FIG. 3 is a perspective view of a portion of frame of the chair of FIG. 1, illustrating the bracket assemblies between the backrest and headrest portions of the chair in a first, non-tilted position.

FIG. 3 is a perspective view of the frame 18 of the chair back 14 in the non-tilted position in isolation and without padding, upholstery or other attachments. The frame 18 of FIG. 3 is made of plywood sections secured together in a conventional manner (i.e., adhesives and fasteners), although frames 18 may be made of hardwood or other materials, depending on the chair 10. The frame 18 includes a headrest frame portion 20 and a backrest frame portion 22. The headrest frame portion 20 is tiltably mounted on the backrest frame portion 22 on one side by a multi-position bracket assembly 24 and on the other side by a simple hinge 26. The bracket assembly 24 connecting the headrest frame portion 20 and the backrest frame portion 22 allows the multi-position headrest portion 12 to move between and remain in the non-tilted and forwardly tilted positions. Although one bracket assembly 24 is shown in FIG. 3, in other embodiments, two bracket assemblies 24 may be used, with the hinge 26 replaced by another bracket assembly 24.

Figure 4:
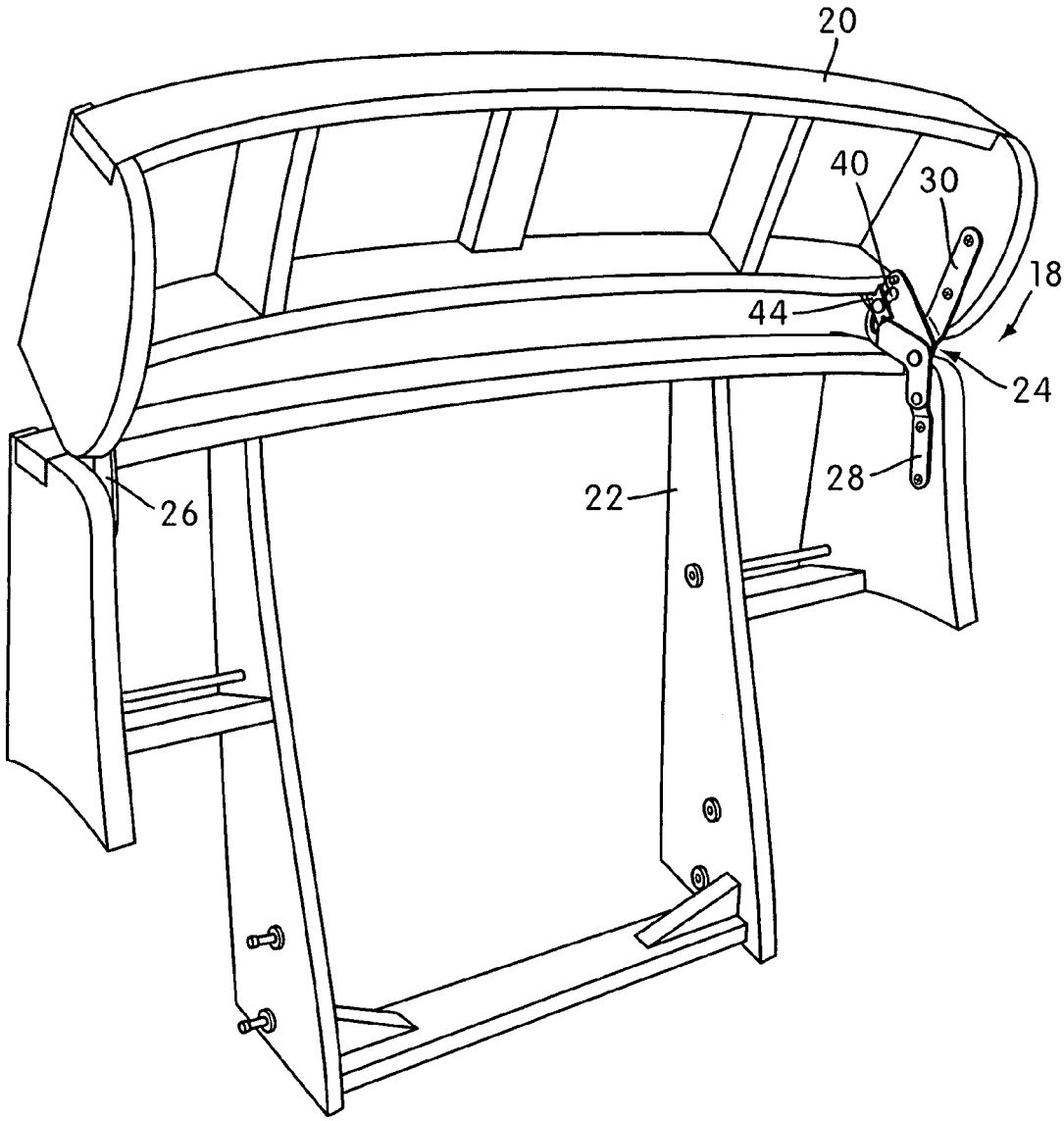
FIG. 4 is a perspective view of the portion of the chair frame of FIG. 3 in a second, tilted position.
Figure 5:
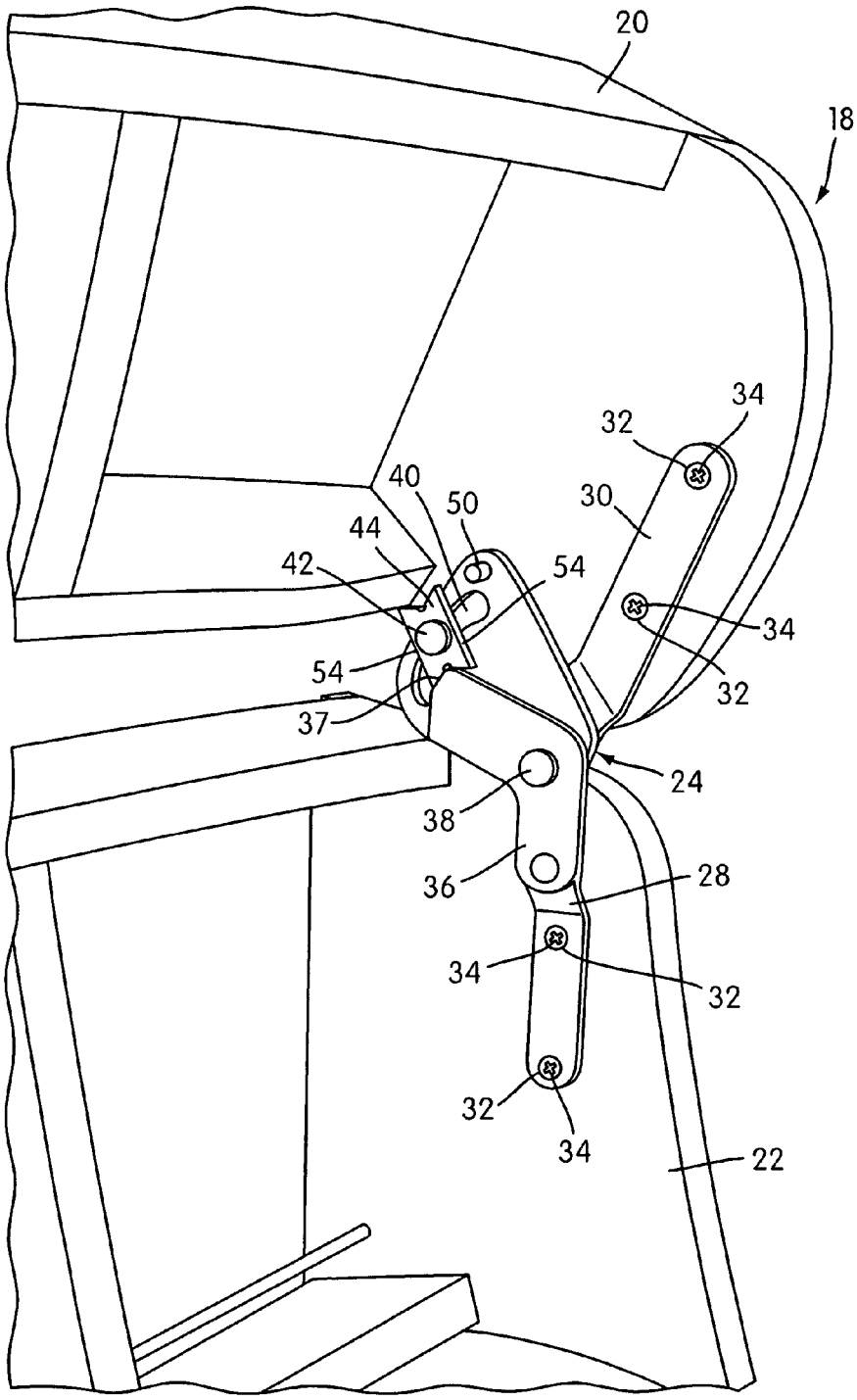
FIG. 5 is an enlarged perspective view of a portion of the chair frame of FIG. 4 illustrating the tilted position of the bracket assemblies in more detail.

FIG. 4 is another perspective view of the frame 18 in the forwardly tilted position, and FIG. 5 is an enlarged perspective view of a portion of the frame 18 in forwardly tilted position. As shown in FIGS. 3–5, the bracket assembly 24 includes a first bracket member 28 attached to the backrest frame portion 22 and a second bracket member 30 attached to the headrest frame portion 20. Each of the bracket members 28, 30 is generally "L-shaped" and provides fastener holes 32 through which conventional fasteners, such as wood screws 34, may be secured to attach the bracket members 28, 30 to the respective frame portions 20, 22. A shoulder piece 36 is fixedly mounted to the first bracket member 28 to form a raised portion or shoulder 37, the purpose of which will be described below. The two bracket members 28, 30 are pivotally connected together by a central pivot pin 38, which, in the embodiment shown in the Figures, also passes through the shoulder piece 36.

Figure 6:
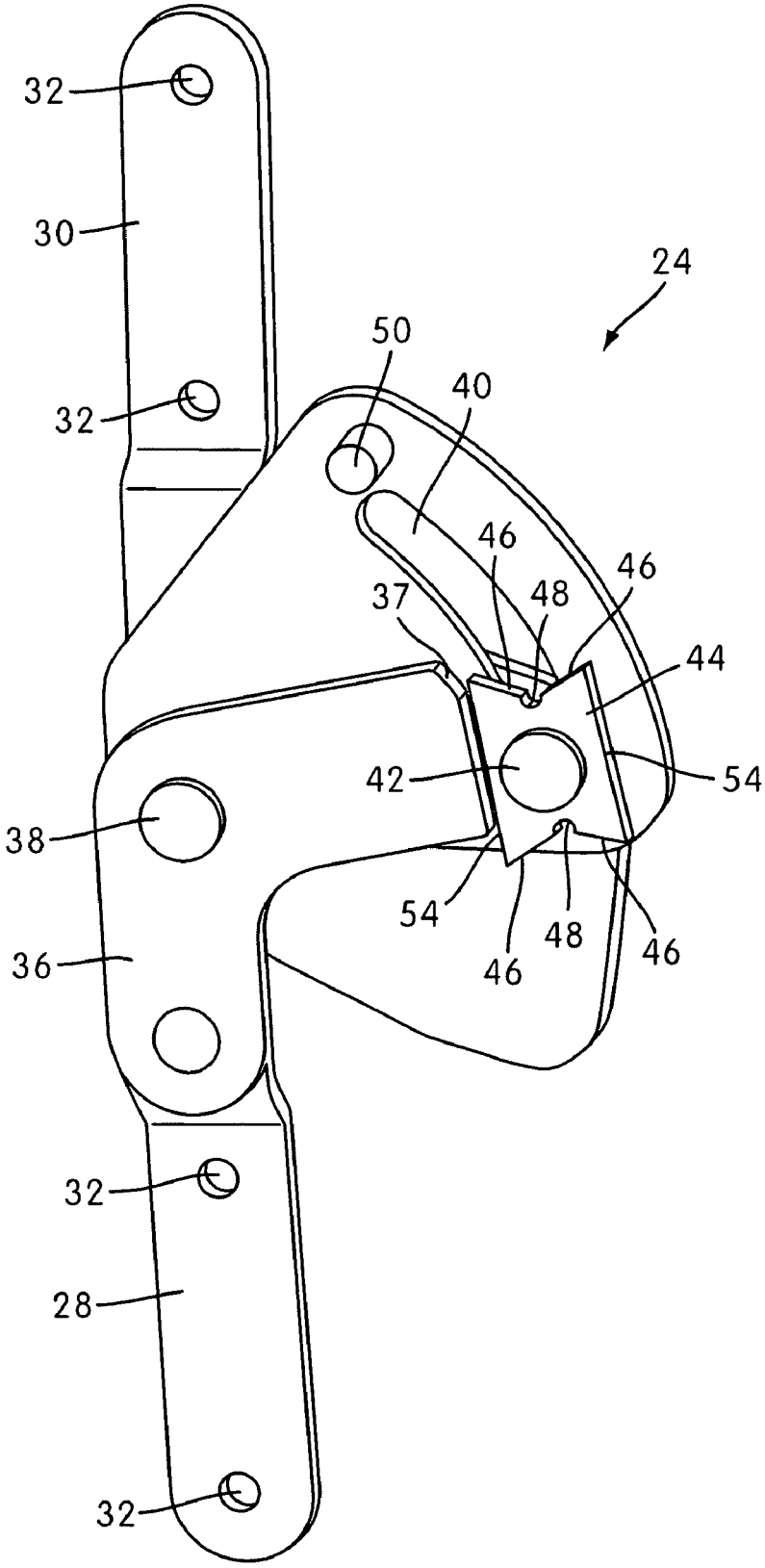
FIG. 6 is a perspective view of a bracket assembly in isolation, illustrating the first, non-tilted position.

FIG. 6 is a perspective view of a bracket assembly 24 in isolation in the non-tilted position shown in FIG. 3. As shown in FIGS. 3 and 6, the first bracket member 28 includes an arcuate slot 40. A mounting member 42 secured to the second bracket member 30 is constructed and arranged to move along the arcuate slot 40. In the embodiment shown, the mounting member 42 is received in the arcuate slot 40, although other embodiments are possible. The mounting member 42 acts as a pivotal axis for a catch member 44 that is mounted for rotation on it.

The catch member 44 is a generally rectangular component that is symmetric about its longitudinal axis and its transverse axis, giving it an overall "butterfly" shape. At each end, the catch member 44 includes a symmetric pair of angled edges 46 that slope outwardly from the center toward the edges. The angled edges 46 each have equal slope. In each end of the catch member 44, a central rounded notch 48 is formed where the angled edges 46 meet. The rounded notch 48 is provided as a matter of convenience to facilitate tooling; the notch 48 may be omitted and the two angled edges 46 may meet in a sharp "V" without any degradation in the performance of the catch member 44.

In the non-tilted position illustrated in FIGS. 3 and 6, the mounting member 42 is at one end of its travel along the arcuate slot 40, such that the length of the catch member 44 is aligned in generally the same direction that the arcuate slot 40 extends. The catch member 44 rests adjacent to the shoulder piece 36. If a separate shoulder piece 36 is not provided, the first bracket member 28 may be stamped, machined, or otherwise formed to an appropriate raised profile.

Figure 7:
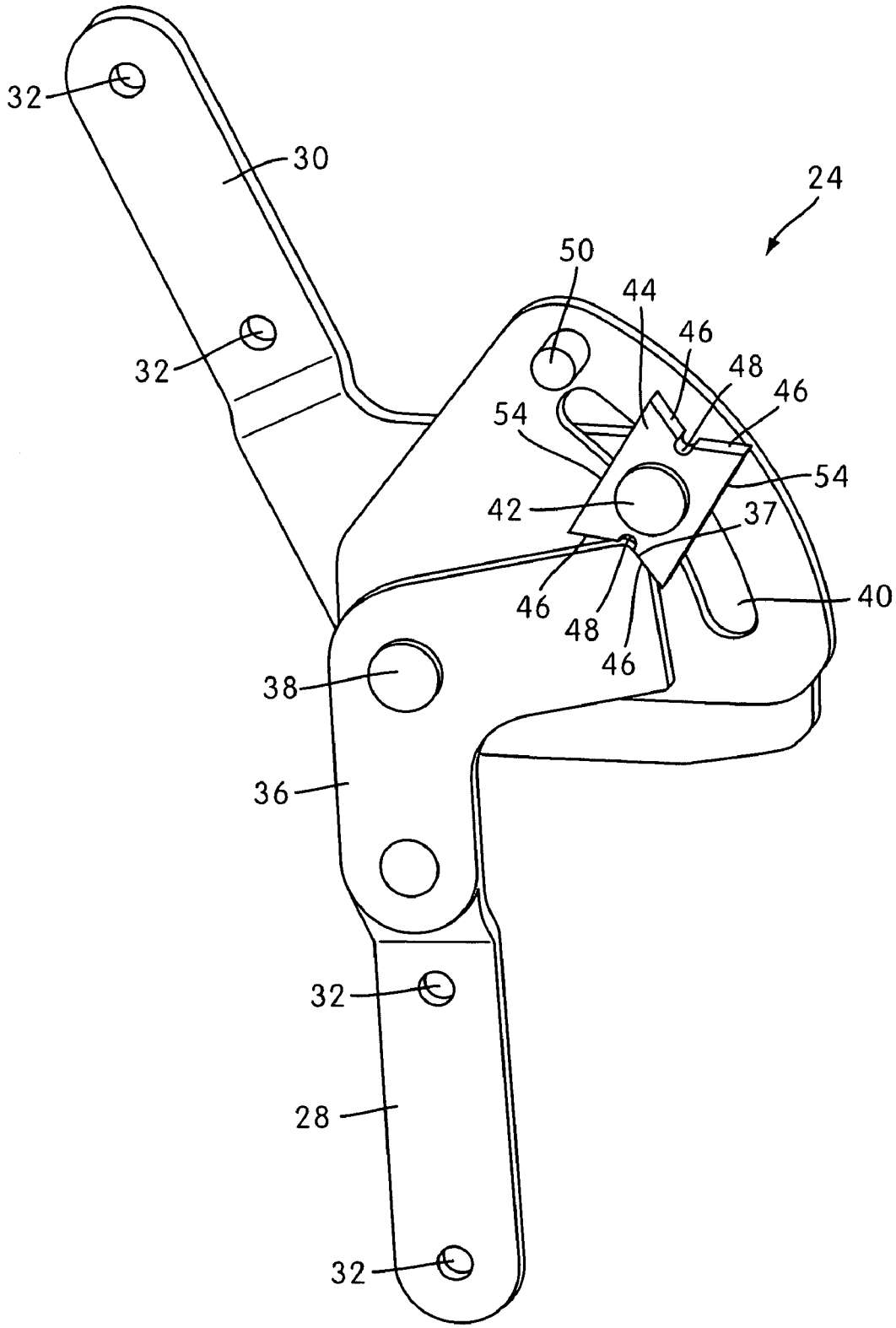
FIG. 7 is a perspective view of a bracket assembly in isolation, illustrating the second, tilted position.
Figure 8:
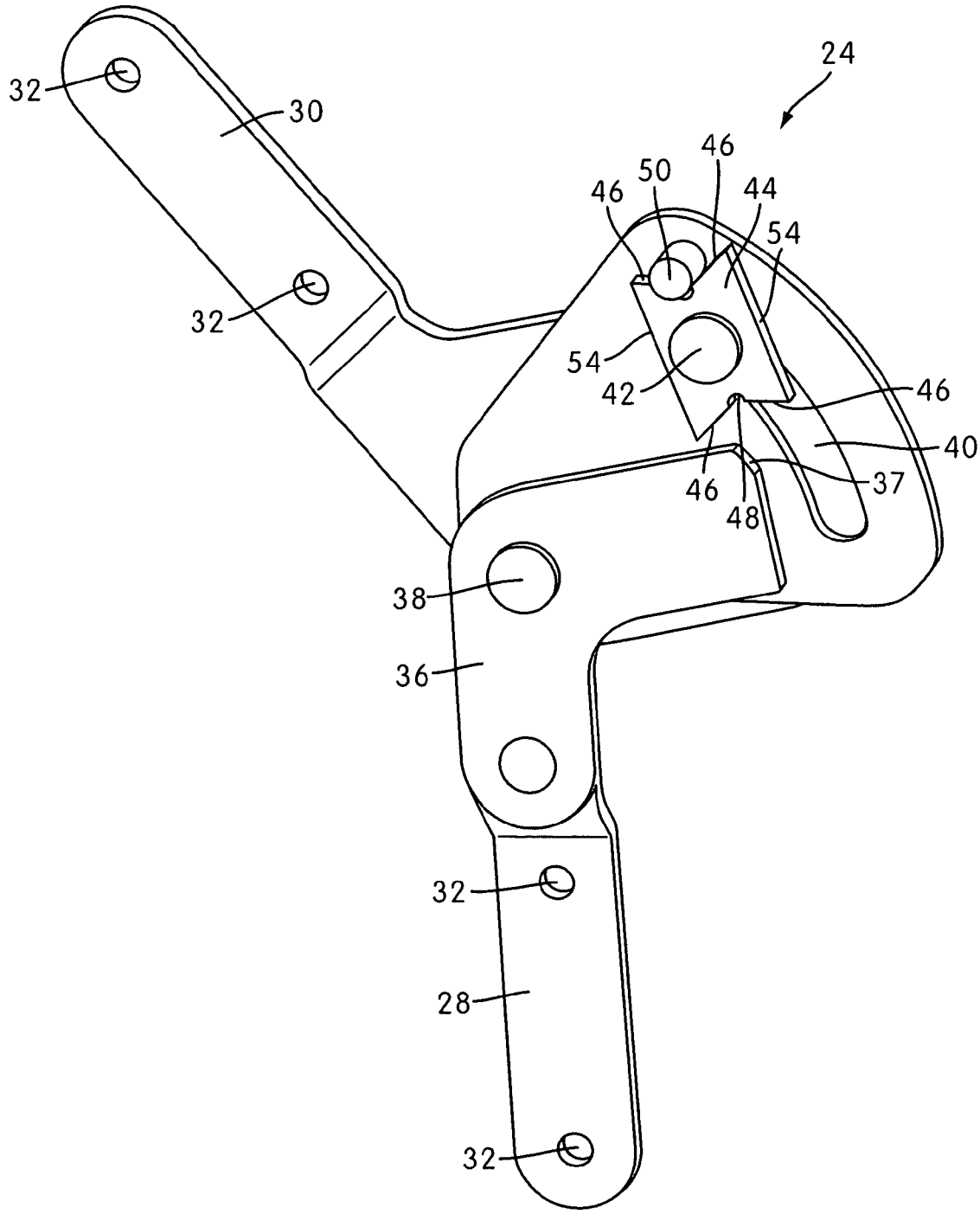
FIG. 8 is a perspective view of a bracket assembly in isolation, illustrating one transitional position intermediate the first and second positions.

As the user moves the multi-position headrest portion 12 forwardly to the end of its travel, the mounting member 42 and catch member 44 slide along the arcuate slot 40. FIG. 8 is a perspective view of the bracket assembly 24 in isolation, showing the position of the mounting member 42 and catch member 44 when the multi-position headrest portion 12 has moved forwardly to the end of its travel from the non-tilted position. In the position illustrated in FIG. 8, one set of angled edges 46 has contacted an alignment stop 50 that is mounted on the first bracket member 28 adjacent one end of the arcuate slot 40 so that the alignment stop 50 contacts and engages the two angled edges 46 on one end of the catch member 44. The contact between the angled edges 46 and the alignment stop 50 causes the catch member 38 to rotate slightly (counterclockwise, with respect to the coordinate system of FIG. 8), enough so that the set of angled edges 46 on the opposite end of the catch member 44 will strike and engage the angled shoulder 37 of the shoulder piece 36, causing the catch member 44 to become lodged on the shoulder 37, unable to fall back into the non-tilted position. The resulting position of the bracket assembly 24 is shown in FIG. 7, a perspective view of the bracket assembly 24 in isolation, as well as in FIGS. 4 and 5. The position of the bracket assembly 24 shown in FIGS. 4, 5, and 7 establishes the tilted position of the headrest portion 12 shown in FIG. 2.

As shown in FIGS. 4, 5, and 7, one pair of angled edges 46 has become lodged on the angled shoulder 37 of the shoulder piece 36, causing the catch member 44 to extend diagonally across the arcuate slot 40. When the catch member 44 is in the position shown in FIGS. 4, 5, and 7, the first and second bracket members 28, 30 cannot be moved toward the position shown in FIG. 6 because of the engagement of the catch member 44 and the angled shoulder 37.

When the user chooses to return the headrest portion 12 to the non-tilted position, he or she once again moves the headrest portion 12 to the end of its angular travel. The movement of the headrest portion 12 forwardly causes the catch member 44 to be moved away from the shoulder and toward the alignment stop 50. As the headrest portion 12 reaches the end of its travel, the catch member 44 is forced against the alignment stop 50, which causes it to rotate clockwise, resulting in the position shown in FIG. 9, in which the catch member 44 extends in a direction generally perpendicular to the direction of the arcuate slot 40.

Figure 9:
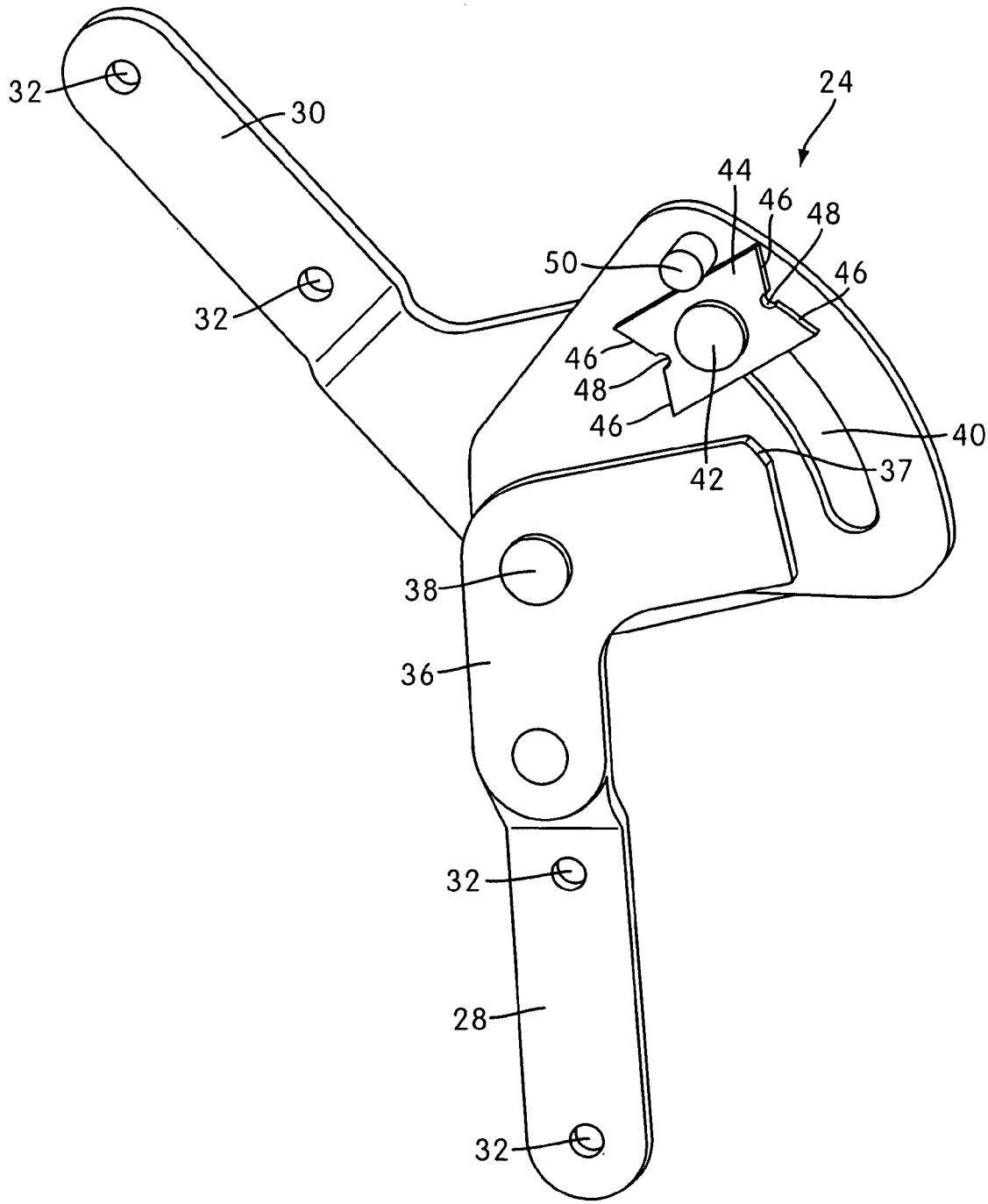
FIG. 9 is a perspective view of a bracket assembly in isolation, illustrating another transitional position intermediate the first and second positions.

When the user releases the multi-position headrest portion 12 and allows it to fall back toward the non-tilted position shown in FIG. 1, the bracket assembly 24 moves from the position shown in FIG. 9 toward the position shown in FIG. 6. As it moves along the arcuate slot 40, the long edge 54 of the catch member 44 that is opposite the alignment stop 50 will strike the shoulder 37 of the shoulder piece 36, causing it to rotate into a position generally parallel with the arcuate slot 40, such that the first and second bracket members 28, 30 can return to the position shown in FIG. 6 without any obstructions. For each movement from the non-tilted position of the headrest 12 to the forwardly tilted position and back to the non-tilted position, the catch member 44 rotates approximately 180°.

Figure 10:
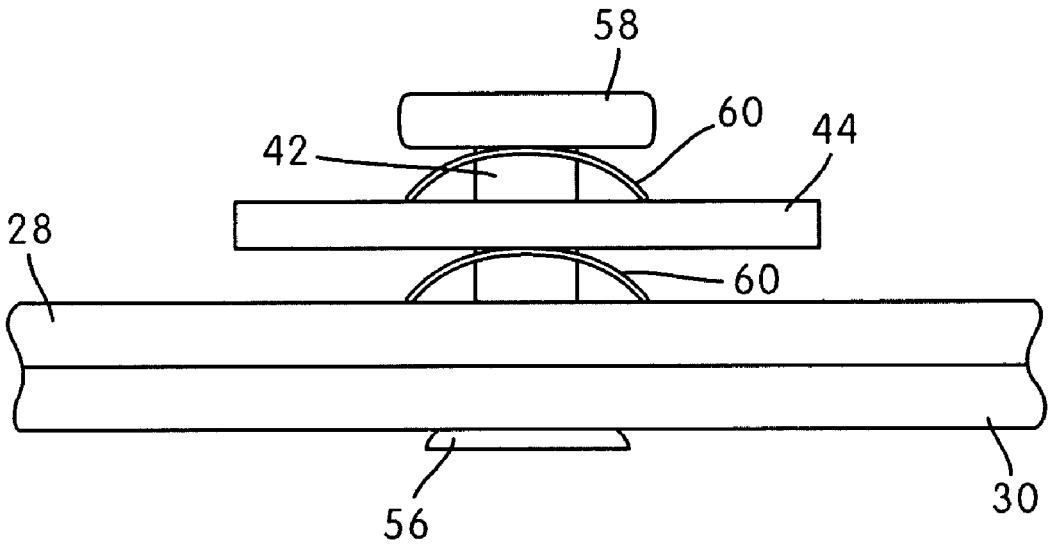
FIG. 10 is a side elevational view of a portion of a bracket assembly in isolation.

As those of skill in the art will appreciate, it may be undesirable to allow the catch member 44 to rotate freely about the mounting member 42, because free rotation of the catch member 44 may cause it to be out of position during one or more of the necessary movements. Therefore, the bracket assembly 24 preferably includes a mechanism or structure that allows the catch member 44 to rotate when it is forced against the shoulder 37 or the alignment stop 50 but otherwise restricts rotation. FIG. 10 is a side elevational view of a portion of the bracket assembly 24 illustrating one such mechanism.

As shown in FIG. 10, the mounting member 42 extends through the catch member 44, the first bracket member 28, and the second bracket member 30, terminating on the underside of the second bracket member 30 in a lip or flange 56. A similar lip or flange 58 on the top of the mounting member 42 keeps the mounting member 42 in place. Between the lower surface of the catch member 44 and the first bracket member 28 and the upper surface of the catch member 44 and the flange 58, spring washers 60 are placed. The spring washers 60 exert a normal force on the catch member 44, which, because of the frictional interaction of the components, makes it more difficult for the catch member 44 to rotate. The spring washers 60 are advantageous because they provide relatively great spring force while using a minimum of space. Depending on the embodiment, the spring washers 60 may be Belleville or disc spring washers or wave spring washers. Conventional compression springs may also be used, although the height of the mounting member 42 may need to be increased (and the sizes of the other features changed appropriately) to accommodate them.

Typically, the components of the bracket assemblies 24 would be made of steel or another metal, such as aluminum or an aluminum alloy. However, in certain embodiments, particularly with headrest portions 12 that are relatively light, it may be possible to make the bracket assemblies 24 from plastic materials. In order to achieve smooth motion, it may be desirable to lubricate the central pivot pin 38 or to provide lubricious washers on the central pivot pin 38 between the first and second bracket members 28, 30. The tilt provided in the forwardly tilted position of the headrest portion 12 may be arbitrarily selected by modifying the size and spacing of the features of the bracket assembly 24, including the size of the catch member 44 and the position of the alignment stop 50.

A headrest portion 12 mounted on a bracket assembly 24 has certain advantages over other potential methods and apparatuses for articulating a headrest portion 12. For example, the operation of the bracket 24 virtually noiseless, especially when muffled by the padding and upholstery on the chair 10. (By contrast, a more traditional "ratcheting" mechanism with a pawl that engages and disengages various teeth generally produces a series of loud clicking noises.) Additionally, because of the nature of the bracket assembly 24, the manufacturing and assembly tolerances are relatively large.

Although the invention has been described with respect to several embodiments, the embodiments are intended to be exemplary, rather than limiting. Variations and modifications of the invention are possible within the scope of the appended claims.

What is claimed is:

1. A multi-position support bracket comprising:

a first bracket member having an arcuate slot formed therein and a raised portion defining a shoulder substantially proximate to the arcuate slot;

a second bracket member pivotally connected to the first bracket member, the second bracket member having a mounting member constructed and arranged to move along the arcuate slot in the first bracket member as the first and second bracket members are pivoted with respect to one another;

a catch member rotatably mounted on the mounting member atop the first bracket member, the catch member having first and second ends, each of the ends having a pair of angularly oriented edges, each of the ends being adapted to engage at least a portion of the shoulder when the catch member is oriented in a shoulder engaging position and to prevent engagement with the shoulder when the catch member is oriented in a non-engaging position; and an alignment stop mounted on the first bracket member substantially proximate to one end of the arcuate slot, the alignment stop being sized and arranged to be at least partially received in one of the ends of the catch member to orient the catch member alternately in the shoulder engaging and non-engaging positions.

2. The multi-position support bracket of claim 1, wherein a first pivotal movement of the first bracket member relative to the second bracket member in a first direction from an initial position causes engagement of the catch member and the alignment stop, thereby causing the catch member to assume the shoulder engaging position, such that a movement of the first bracket member relative to the second bracket member in a second direction will cause engagement of the catch member and the shoulder, thus preventing further movement in the second direction; and wherein a second pivotal movement subsequent to the first pivotal movement of the first bracket member relative to the second bracket member in the first direction causes engagement of the catch member and the alignment stop, thereby causing the catch member to assume the shoulder non-engaging position so as to allow the first and second bracket members to be returned to the initial position when moved in the second direction.

3. The multi-position support bracket of claim 1, further comprising a first spring washer mounted on the mounting member between the first bracket member and the catch member.

4. The multi-position support bracket of claim 3, further comprising a second spring washer mounted on the mounting member between the catch member and an upper flange of the mounting member.

5. The multi-position support bracket of claim 1, wherein the raised portion comprises a third bracket member fixedly mounted on the first bracket member.

6. The multi-position support bracket of claim 1, wherein each of the first and second bracket members further comprises an attachment portion constructed and arranged to be attached to a surface.

7. A chair, comprising:

a seat; and a back including a headrest portion and a backrest portion;

one or more multi-position support brackets connected between the headrest portion and the backrest portion so as to mount the headrest portion on the backrest portion for movement between a forwardly tilted position and a non-tilted position, and for retention in the tilted position, each of the support brackets including:

a first bracket member having an arcuate slot formed therein and a raised portion defining a shoulder substantially proximate to the arcuate slot;

a second bracket member pivotally connected to the first bracket member, the second bracket member having a mounting member constructed and arranged to move along the arcuate slot in the first bracket member as the first and second bracket members are pivoted with respect to one another;

a catch member rotatably mounted on the mounting member atop the first bracket member, the catch member having first and second ends, each of the ends having a pair of angularly oriented edges, each of the ends being adapted to engage at least a portion of the shoulder when the catch member is oriented in a shoulder engaging position, thereby establishing the forwardly tilted position of the headrest portion, and to prevent engagement with the shoulder when the catch member is oriented in a non-engaging position, thereby permitting the non-tilted position;

an alignment stop mounted on the first bracket member substantially proximate to one end of the arcuate slot, the alignment stop being sized and arranged to be at least partially received in one of the ends of the catch member to orient the catch member alternately in the shoulder engaging and non-engaging positions.

8. The chair of claim 7, wherein a first pivotal movement of the first bracket member relative to the second bracket member in a first direction from an initial position causes engagement of the catch member and the alignment stop, thereby causing the catch member to assume the shoulder engaging position, such that a movement of the first bracket member relative to the second bracket member in a second direction will cause engagement of the catch member and the shoulder, thus preventing further movement in the second direction; and wherein a second pivotal movement subsequent to the first pivotal movement of the first bracket member relative to the second bracket member in the first direction causes engagement of the catch member and the alignment stop, thereby causing the catch member to assume the shoulder non-engaging position so as to allow the first and second bracket members to be returned to the initial position when moved in the second direction.

9. The chair of claim 7, further comprising a first spring washer mounted on the mounting member between the first bracket member and the catch member.

10. The chair of claim 9, further comprising a second spring washer mounted on the mounting member between the catch member and an upper flange of the mounting member.

11. The chair of claim 7, wherein the raised portion comprises a third bracket member fixedly mounted on the first bracket member.

12. The chair of claim 7, wherein the chair is a reclining chair.

13. A chair comprising:

a upholstered seat;

a upholstered back including a headrest portion and a backrest portion; and one or more multi-position support brackets connected between the headrest portion and the backrest portion so as to mount the headrest portion on the backrest portion for movement between a forwardly tilted position and a non-tilted position, and for retention in the tilted position, each of the support brackets including:

a first bracket member having an arcuate slot formed therein and a raised portion defining a shoulder substantially proximate to the arcuate slot, the first bracket member including a connecting portion adapted to be connected to one of the headrest portion or the backrest portion;

a second bracket member pivotally connected to the first bracket member, the second bracket member having a mounting member constructed and arranged to be received in and to move along the arcuate slot in the first bracket member as the first and second bracket members are pivoted with respect to one another, the second bracket member including a connecting portion adapted to be connected to one of the headrest portion and the backrest portion;

a catch member rotatably mounted on the mounting member atop the first bracket member, the catch member having first and second ends, each of the ends having a pair of angularly oriented edges, each of the ends being adapted to engage at least a portion of the shoulder when the catch member is oriented in a shoulder engaging position, thereby establishing the forwardly tilted position of the headrest portion, and to prevent engagement with the shoulder when the catch member is oriented in a non-engaging position, thereby permitting the non-tilted position;

an alignment stop mounted on the first bracket member substantially proximate to one end of the arcuate slot, the alignment stop being sized and arranged to be at least partially received in one of the ends of the catch member to orient the catch member alternately in the shoulder engaging and non-engaging positions; and one or more spring washers mounted on the mounting member so as to exert force on the catch member, thereby at least partially restricting rotational motion of the catch member to motion imparted by the alignment stop and motion imparted by the shoulder.

* * * * *